US011098504B2

(12) United States Patent
Taylor et al.

(10) Patent No.: US 11,098,504 B2
(45) Date of Patent: Aug. 24, 2021

(54) VEHICLE CLOSURE LINEAR CINCHING SYSTEM

(71) Applicant: Brose Schliesssysteme GmbH & Co. Kommanditgesellschaft, Wuppertal, Wuppertal (DE)

(72) Inventors: Kim Taylor, Farmington Hills, MI (US); Andrew Lakerdas, London (CA); Mark Farrugia, Clarkston, MI (US)

(73) Assignee: Brose Schliesssysteme GmbH & Co. Kommanditgesellschaft, Wuppertal, Wuppertal (DE)

( * ) Notice: Subject to any disclaimer, the term of this patent is extended or adjusted under 35 U.S.C. 154(b) by 235 days.

(21) Appl. No.: 16/165,122

(22) Filed: Oct. 19, 2018

(65) Prior Publication Data

US 2020/0123816 A1 Apr. 23, 2020

(51) Int. Cl.

| | |
|---|---|
| ***E05B 81/20*** | (2014.01) |
| ***E05F 15/622*** | (2015.01) |
| ***E05B 83/18*** | (2014.01) |
| ***E05B 79/20*** | (2014.01) |

(52) U.S. Cl.

CPC ..... *E05B 81/20* (2013.01); *E05B 79/20* (2013.01); *E05B 83/18* (2013.01); *E05F 15/622* (2015.01); *E05Y 2900/546* (2013.01)

(58) Field of Classification Search

CPC ..... E05F 15/622

See application file for complete search history.

(56) References Cited

U.S. PATENT DOCUMENTS

| | | | | |
|---|---|---|---|---|
| 4,333,269 | A * | 6/1982 | Bascou | E05F 15/619 49/280 |
| 6,435,600 | B1 * | 8/2002 | Long | B60J 5/06 296/155 |
| 6,719,356 | B2 * | 4/2004 | Cleland | E05F 1/1091 296/146.8 |
| 7,093,887 | B2 * | 8/2006 | Mrkovic | E05B 81/20 192/48.2 |
| 9,376,850 | B2 * | 6/2016 | Suzuki | E05F 1/105 |
| 9,677,318 | B2 * | 6/2017 | Rosales | E05B 81/20 |
| 10,005,498 | B2 * | 6/2018 | Rosales | B62D 33/037 |
| 10,626,660 | B2 * | 4/2020 | Ikenori | E05F 15/611 |
| 2006/0181108 | A1 * | 8/2006 | Cleland | E05F 15/43 296/146.4 |
| 2011/0175375 | A1 | 7/2011 | Terhaar et al. | |
| 2012/0285087 | A1 * | 11/2012 | Eggeling | E05B 81/14 49/29 |

(Continued)

FOREIGN PATENT DOCUMENTS

| | | | |
|---|---|---|---|
| DE | 102005060206 | A1 | 8/2007 |
| DE | 202007011931 | U1 | 1/2009 |

*Primary Examiner* — Catherine A Kelly

(74) *Attorney, Agent, or Firm* — Brooks Kushman, P.C.

(57) ABSTRACT

A vehicle closure system for use with a vehicle closure is provided. The vehicle closure may be pivotally coupled to a vehicle body and movable from an open position to a closed position by a spindle assembly. The vehicle closure system may include a controller configured to, responsive to the vehicle closure moving to the closed position, powering the spindle assembly to retract a slide connected to a latch by a cable so that the latch moves from a secondary latch position to a primary latch position.

20 Claims, 6 Drawing Sheets

(56) References Cited

U.S. PATENT DOCUMENTS

| | | | | |
|---|---|---|---|---|
| 2016/0186468 | A1* | 6/2016 | Ilea | E05B 83/18<br>292/201 |
| 2018/0058116 | A1* | 3/2018 | Erices | E05B 79/20 |
| 2019/0169886 | A1* | 6/2019 | Rosales | E05F 15/00 |
| 2020/0263457 | A1 | 8/2020 | Rosales | |

* cited by examiner

VEHICLE CLOSURE LINEAR CINCHING SYSTEM

TECHNICAL FIELD

The present disclosure relates to systems for vehicle closures.

BACKGROUND

Vehicles may include one or more closures, such as, hatches, doors, tailgates, liftgates. Certain closures may close automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure must be sufficient to overcome pressure associated with the closure and the seal.

SUMMARY

One general aspect of this disclosure includes a vehicle closure system for use with a vehicle closure, pivotally coupled to a vehicle body and movable from an open position to a closed position, the vehicle closure system including: a linear drive including a first end, attachable to the vehicle body, and a second end that is configured to be coupled to the vehicle closure. The vehicle closure system also includes a latch, fixed to the vehicle closure, configured to engage a striker fixed to the vehicle and move from a secondary latch position to a primary latch position. The vehicle closure system also includes a fixed member connected to the vehicle closure and a slide coupled to the second end of the linear drive and operatively connected to the fixed member where the slide is configured to move between a retracted position, when the vehicle closure is in the open position, and a deployed position, when the vehicle closure is in the closed position. The vehicle closure system also includes a cable operatively connected between the slide and the latch where when the slide moves from the retracted position to the deployed position the latch moves from the secondary latch position to the primary latch position.

Another general aspect of this disclosure includes a vehicle closure system for use with a vehicle closure, pivotally coupled to a vehicle body and movable from an open position to a closed position by a spindle assembly, the vehicle closure system including: a controller configured to, responsive to the vehicle closure moving to the closed position, powering the spindle assembly to retract a slide connected to a latch by a cable so that the latch moves from a secondary latch position to a primary latch position.

Yet another general aspect of this disclosure includes an actuation assembly operatively coupled to a spindle assembly, configured to close a vehicle hatch pivotally connected to a vehicle body, and a latch fixed to the vehicle hatch, the actuation assembly including: a base member, attachable to the vehicle body, having an elongated body that defines a longitudinal axis where the body includes two sides that are parallel to the longitudinal axis and each of the sides include a guide. The actuation assembly also includes a slide having an elongated body that is slidably coupled to the guide on each of the sides and where the slide is operatively coupled to the spindle assembly and the latch by a cable so that when the spindle assembly is powered to move the vehicle hatch from a partially closed position to a closed position, the slide translates to move the latch from a secondary latch position to the primary latch position.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A cinching system may be employed to pull the closure from a secondary latching position to a primary latching position, thereby overcoming the pressure of the seal and ensuring automatic closing of the closure. For example, U.S. Pat. No. 9,677,318 discloses one example of a cinching system and is hereby incorporated by reference in its entirety.

As another example, U.S. application Ser. No. 15/828,879 discloses a transfer element, such as a lever, that exerts a pulling force to a catch to move from the secondary latch position to a primary latch position and is hereby incorporated by reference in its entirety. One disadvantage of the transfer element is the space required to facilitate rotational movement of the lever. Another disadvantage of the transfer element is that actuating the transfer element requires a varying force to move from the secondary latch position to a primary latch position.

Figure 4:
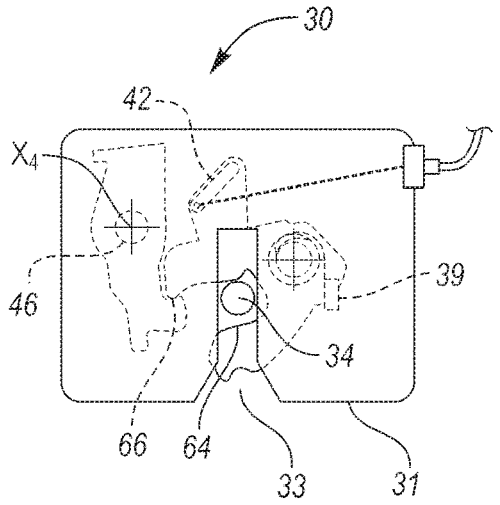
FIG. 4 is a detailed view of the exemplary latch within the exemplary closure in a secondary latch position.
Figure 5:
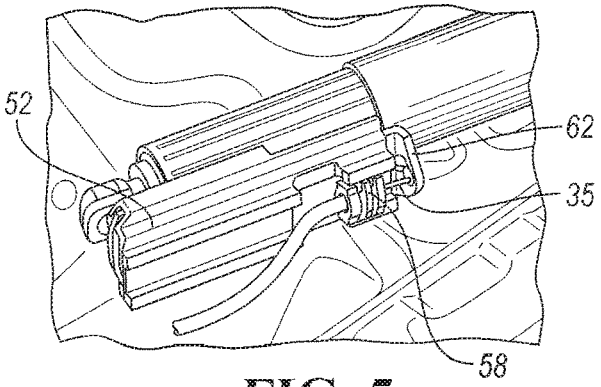
FIG. 5 is a detailed view of an exemplary actuation assembly in a deployed position.
Figure 6:
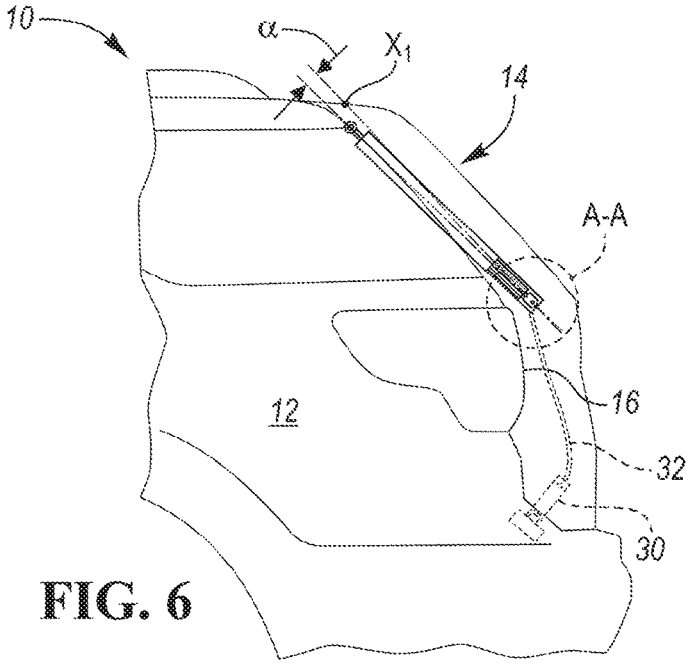
FIG. 6 partial-plan view of the exemplary vehicle that includes the closure in a closed position.

With reference to FIG. 1 through FIG. 8, a vehicle 10 provided with a vehicle body 12 and a vehicle panel, such as a hatch, door, tailgate, liftgate, or closure 14 pivotally attached to the vehicle body. The closure 14 may move from an open position (FIG. 1) to a partially closed position (FIG. 3), to a closed position (FIG. 6). In partially closed and closed position, the closure 14 covers or closes one or more openings 16 defined by the vehicle body. In one or more embodiments, "partially closed" refers to the closure 14 being adjacent to the vehicle body 12 but not sealed. In one or more embodiments, the term closed refers to a closure 14 moved into a sealed position.

The vehicle 10 includes a vehicle closure system that may include but is not limited to a drive arrangement, such as a linear, spindle assembly, or spindle drive 18. The spindle drive 18 may include a first or proximal end 20 that may be attached (e.g., pivotally) to the vehicle body 12 at point $X_2$. The spindle drive 18 may include a second or distal end 26 that may be coupled to the closure 14. In one or more embodiments, the phrase "coupled to" means directly or indirectly connected to the closure 14.

Figure 6A:
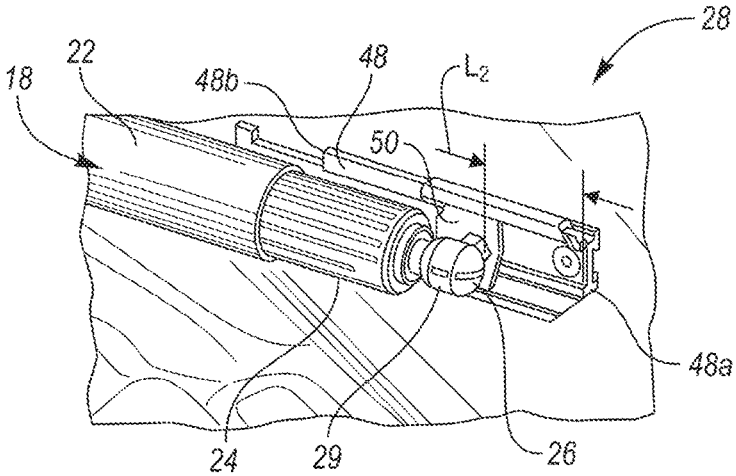
FIG. 6A is a detailed view taken along lines A-A in FIG. 6.
Figure 8:
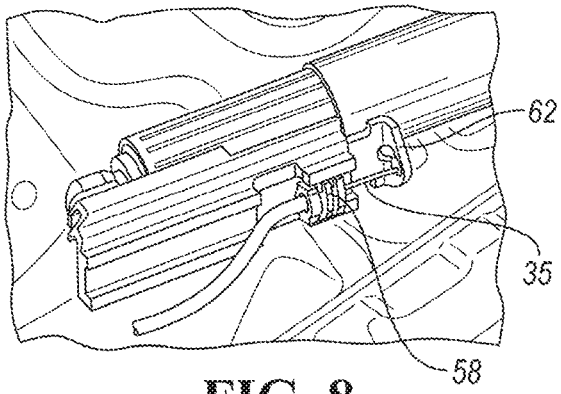
FIG. 8 is a detailed view of the exemplary actuation assembly in a retracted position.

The closure system may also include a slide mechanism 28. The slide mechanism 28 may include a fixed member 48, that may be attached (e.g., directly or indirectly) to the closure 14, and a slide 50 that is configured to move (e.g., slide, translate) from a retracted position (FIG. 1A) to a deployed position with respect to the fixed member 48 (FIG. 6A), and vice-versa. When the closure 14 is in the open position as shown, the slide may be in the retracted position. When the closure is in the closed position, the slide mechanism 28 may move to the deployed position.

Figure 7:
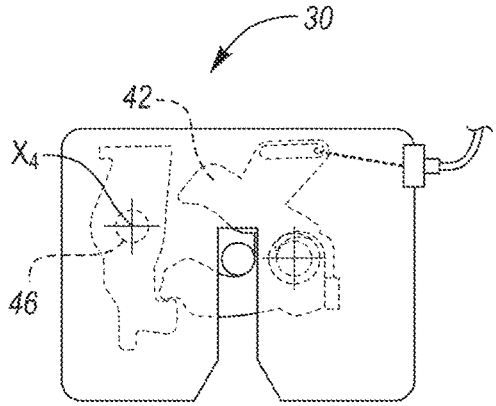
FIG. 7 is a detailed view of the exemplary latch within the exemplary closure in a primary latch position.

The closure 14 may include a lock, latch 30, such as a two-stage latch that may be configured to engage a bolt, rod, member, such as a striker 34 that may be fixed to the vehicle body 12. The latch 30 may be configured to move or actuate from an open position (FIG. 2) to a secondary latch position as shown in FIG. 4. Also, the latch 30 may move from the secondary latch position to a primary latch position as shown in FIG. 7. The slide mechanism 28 may be coupled to the latch 30 by a cable 32. When the slide mechanism 28 actuates from the deployed position to the retracted position, the latch 30 may move from the secondary latch position to the primary latch position. The slide mechanism may move or translate linearly along a first linear axis $A_1$. Alternatively, the slide mechanism 28 may move in a non-linear manner.

The spindle drive 18 may include an outer cover or stationary portion 22 that is movably coupled to a moving portion, such as a translating member 24 or threaded member. While the stationary portion 22 is shown nearest to the proximal end 20, it may be positioned nearest the distal end 26. The translating member 24 may move, slide, or translate along a second linear axis $A_2$ to move the closure 14 between open and closed positions. In one or more embodiments, the first and second axes may be colinear with one another. The closure 14 may be pivotally attached to the vehicle body 12 at pivot axis $X_1$ or some other suitable point.

Figure 1:
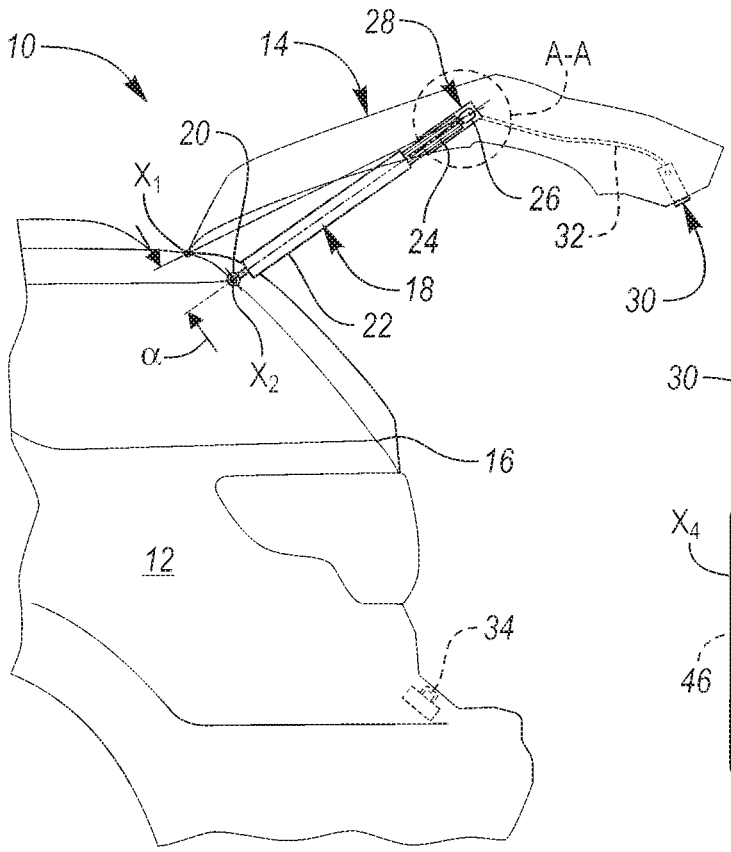
FIG. 1 is a partial-plan view of an exemplary vehicle that includes an exemplary closure in an open position.
Figure 1A:
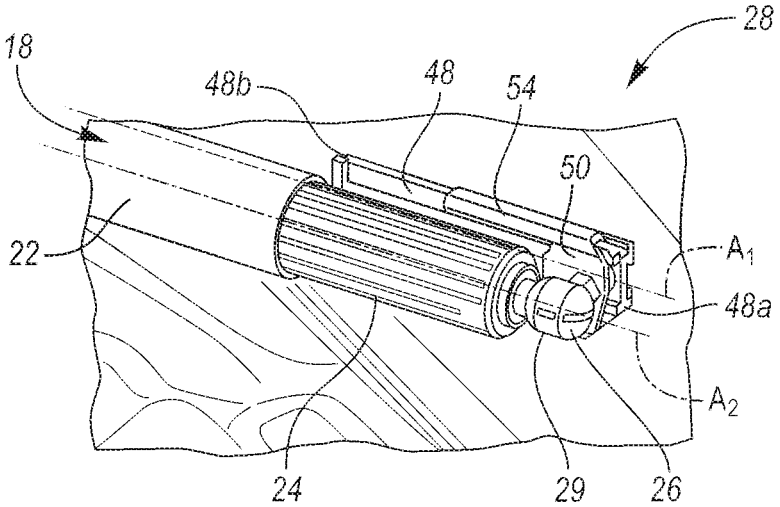
FIG. 1A is a detailed view taken along lines A-A in FIG. 1.

Referring specifically to FIG. 1A, a detailed view taken along line A-A in FIG. 1 illustrates a portion of the spindle drive 18 attached to the slide mechanism 28. As stated above the slide mechanism includes a fixed member 48 and a slide 50 coupled thereto. The fixed member 48 may include a first or proximal end 48*b* and a second or distal end 48*a*. The fixed member may further include a body, such as an elongated body 52 that extends along the first linear axis $A_1$. One or more guide members, such as slots, channels, tracks, or lips 54 may extend from the elongated body 52 in a direction that is parallel to the first linear axis $A_1$. The lips may also curl back towards the first linear axis $A_1$ to facilitate retaining the slide 50. The distal end 26 of the translating member 24 may include an attachment portion such as a ball or hitch 26. The slide 50 may include a slide attachment feature such as a hook, clasp, or ring 29 that engages the hitch 26 to couple the translating member 24 to the slide 50. In one or more embodiments, the ring 29 may engage the outer circumferential surface of the hitch 26. The ring 29 may be attached to the slide by a fastener, such as a rivet or stud.

Figure 2:
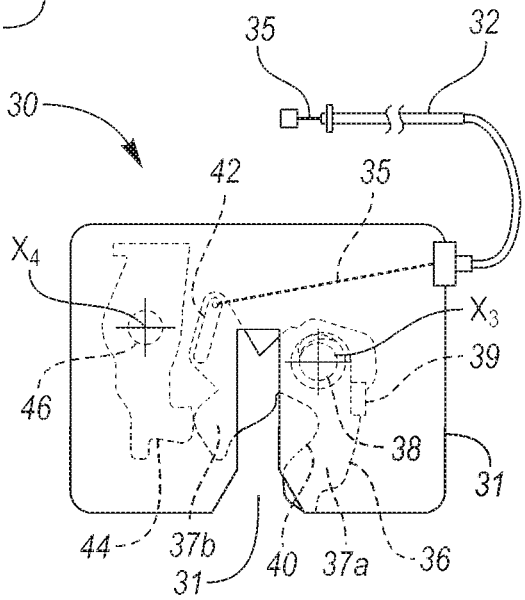
FIG. 2 is a detailed view of an exemplary latch within the exemplary closure in the open position.

Referring specifically to FIG. 2, a plan view of the latch 30 in the open or disengaged position is illustrated. The latch 30 may include a catch 36 that may be disposed within a housing 31 and pivotable about a fastener 38 that defines a pivot axis X3. The catch 36 may be biased or constrained by an elastic member such as a spring 39 that biases a first arm 37*a* of the catch 36 away from the opening 33. A second arm 37*b* of the catch 36 may define a primary engaging surface 40, that may engage the striker 34 when in the primary latch position. A wire 35 of the cable 32 may engage a slot such as an elongated slot 42 that is defined by the catch 36. As shown in FIG. 1A and FIG. 2, the slide 50 is in the retracted position, thus the catch 36 is biased by the elastic spring 39 to the open position so that a second end 42*b* of the slot 42 is engaged or in contact with the wire 35.

The latch 30 may also include a secondary locking member such as a pawl 44 that may be connected to the housing 31 by a fastener 46 that defines a pivot axis $X_4$. The pawl 44 may act provide one or more locking surfaces that cooperate with the catch 36.

Figure 3:
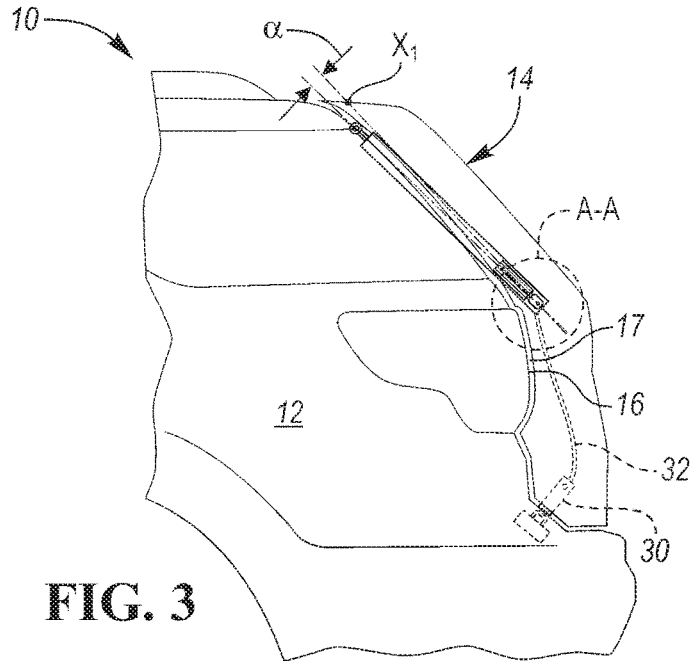
FIG. 3 is a partial-plan view of the exemplary vehicle that includes the closure in a partially closed position.
Figure 3A:
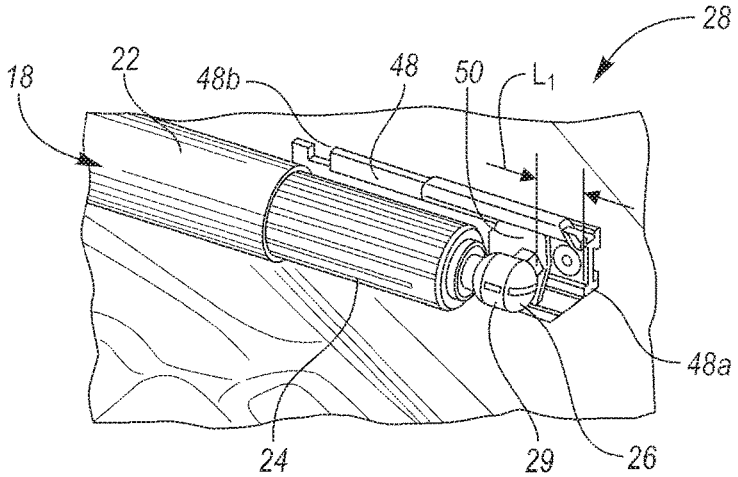
FIG. 3A is a detailed view taken along lines A-A in FIG. 3.

Referring specifically to FIGS. 3 and 3A, a partial plan view of the vehicle 10 provided with the closure 14 that is in a partially open position is provided. The closure 14 may move from the open position to the partially closed position by actuating the spindle drive 18 by an electric motor (not shown), or by disengaging a locking member and allowing the weight of the closure move to the partially closed position, or some combination thereof. As described above, in this position the closure 14 has not overcome the pressure of the seal 17 between the opening 16 and the closure 14. While a visible gap is shown between the closure 14 and the vehicle body 12, this gap is exaggerated for clarity. When the closure is in the partially closed position, the slide mechanism 28 may be positioned in a partially deployed position. The translating member 24 may move or retract in towards the outer cover or fixed portion 22 thus causing the slide 50 move towards the fixed portion 22 by a distance L1.

Figure 9:
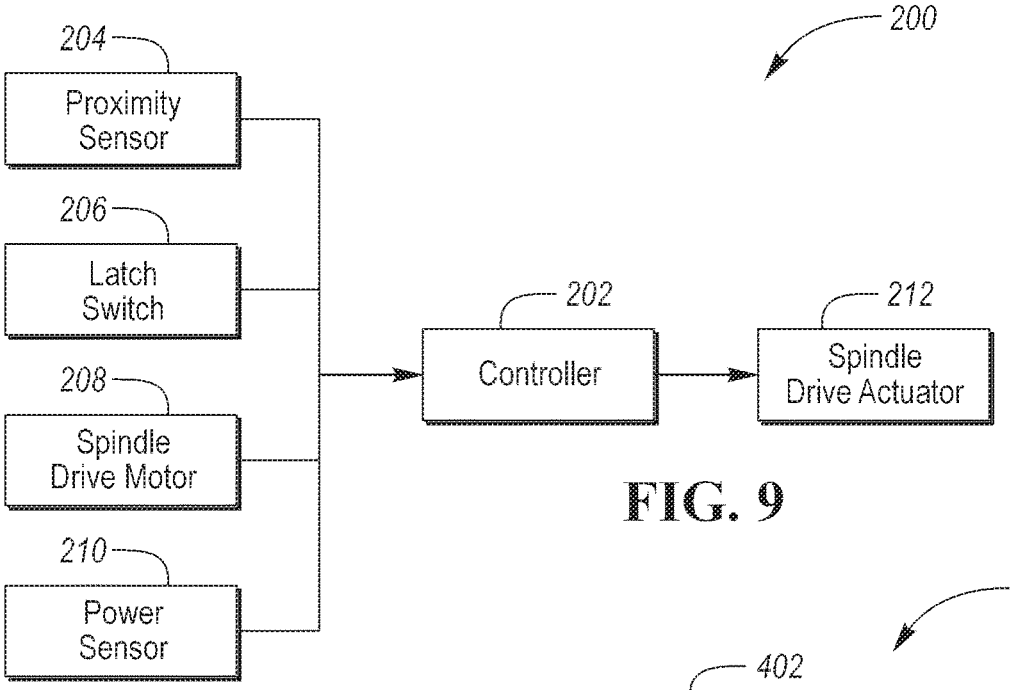
FIG. 9 is a schematic diagram of an exemplary actuation assembly.

Referring specifically to FIG. 4, a plan view of the latch 30 in the secondary latch position is illustrated. In one or more embodiments, a force associated with the weight of the closure 14 may cause the latch 30 to move from the open position to the secondary latch position. Here, the second arm 37*b* of the catch may be engaged with a portion of the pawl 44 and the striker 34. The latch 30 may be operatively coupled to a switch 206 (FIG. 9). In one or more embodiments, the latch switch 206 may be provided by a signal to a controller 202 (FIG. 9) indicating that the latch 30 is in the secondary latch position.

Referring specifically to FIG. 5, a mating side of the slide mechanism attached to the spindle drive 18 is illustrated. In this view, the closure 14 is hidden to better illustrate the slide mechanism 28 and the cable 32. The fixed member 48 may be connected to the closure 14 by one or more fasteners such as bolts or rivets. One end of the cable 32 may terminate at a coupling 58 that may be fixed to the fixed member 48. The wire 35 may extend out of the cable 32 and be fixed to or attached to (e.g., directly or indirectly) to a flange 62 defined by the slide 50. The coupling 58 may be fixed to an outer portion, such as a cover or sheath of the cable 32 to the fixed member 48 so the wire 35 may move relative to the sheath of the cable 32.

Referring specifically to FIG. 6, FIG. 6A, FIG. 7, and FIG. 8, the closure 14 and the closure system are each shown in the closed position. In this position, the closure 14 may be moved to the closed position by rotating the catch 36 so that the primary locking surface 40 of the first arm 37*a* of the catch 36 engages the striker 34. In one or more embodiments, the spindle assembly 18 may be retracted to translate the slide 50 by distance $L_2$ from the position shown in FIG. 3A. Translating the slide 50 by distance $L_2$, actuates the wire 35 connected to the flange 62 to rotate the catch 36 that is coupled to the wire 35. Furthermore, a primary pawl engaging surface 64 may engage an anti-rotation surface 66 of the pawl 44.

Referring to FIG. 9, a schematic diagram of a closure control system 200 is illustrated. The closure control system 200 includes controller 202 that may provide and send several signals associated with the position of at least one of the components of the closure system. For example, a proximity sensor 204 may be provided on the vehicle body 12, the closure 14, the striker 34, the latch, or some combination thereof.

The proximity sensor 204 may provide a signal to the controller 202 to indicate the position of the closure 14, or the position of the latch 30, or both. The controller may be coupled to a spindle drive actuator 212. In one or more embodiments, spindle drive actuator may be a motor operatively connected to the spindle drive 18. In one or more embodiments, the actuator may be a pump, solenoid, or lock that may be operable to extend and retract the spindle drive 18. In response to various inputs, the spindle drive actuator may be actuated to retract and extend the spindle drive 18.

As described above, the latch switch 206 may be actuated once the latch 30 moves from the open position to the secondary latch position and vice-versa. In one or more embodiments, the latch switch 206 may be actuated when the latch 30 moves to the primary latch position. The spindle drive 18 may include a motor 208 provided with a position sensor such as a hall sensor, ripple count sensor, or an electronic control unit, each configured to detect the position of the spindle drive 18. The motor 208 refers to the electric motor and the associated sensors incorporated therein or coupled thereto. Additionally, the motor 208 may detect or determine the speed, direction, or both, of the spindle drive 18 during operation. A power sensor 210, may be operatively connected to the motor and the controller 202. In one or more embodiments, the power sensor may measure voltage, wattage, or current, or some combination thereof, of the motor 208.

Figure 10:
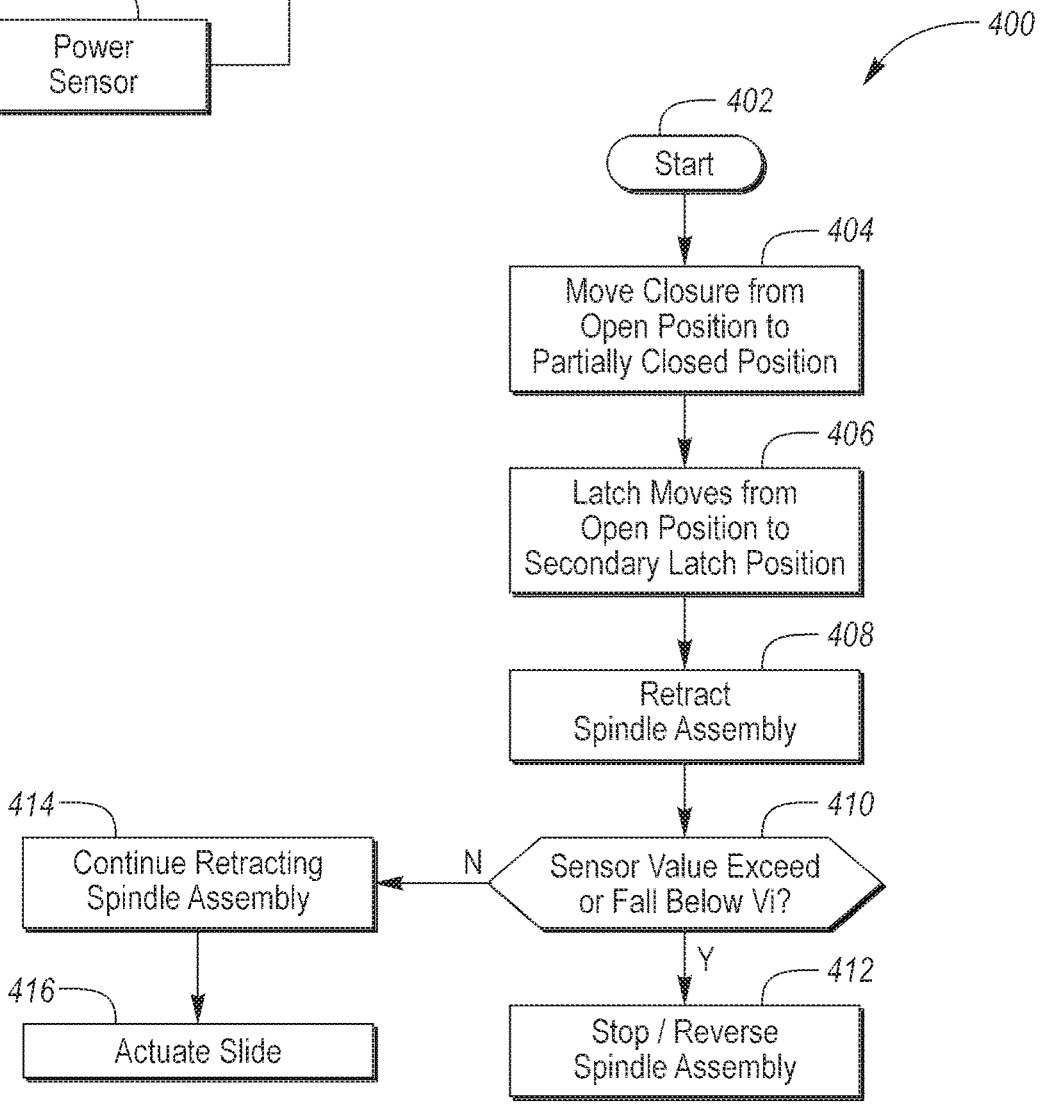
FIG. 10 is a flowchart of an exemplary method of operation of the actuation assembly.

Control logic or functions performed by the controller 202 may be represented by flow charts or similar diagrams, such as the flow chart 400 in FIG. 10. FIG. 10 provides a representative control strategy and/or logic that may be implemented using one or more processing strategies such as polling, event-driven, interrupt-driven, multi-tasking, multi-threading, and the like. As such, various steps or functions illustrated may be performed in the sequence illustrated, in parallel, or in some cases omitted.

The controller 202 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 202 in controlling the spindle drive 18.

Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein but is provided for ease of illustration and description. The control logic may be implemented primarily in software executed by a microprocessor-controlled vehicle 10, spindle drive motor 208, or controller 202.

The control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of several known physical devices that utilize electric, magnetic, and/or optical storage to keep executable instructions and associated calibration information, operating variables, and the like.

In operation 402, the method may start by the controller 202 providing a signal to the spindle drive 18 to move the closure 14 from the open position to the partially closed position. The signal may be sent in response to a user applying a force on the closure 14 to move the closure 14 to the closed position. In one or more embodiments, the signal may be sent in response to a user actuating button within the vehicle 10 or a key fob to close the closure 14.

In operation 404, the closure 14 may be moved from the open position to the partially closed position. This may be accomplished by powering the spindle or allowing the weight of the closure 14 to move the closure 14 to partially closed position, or some combination thereof. Once the closure 14 is moved to the partially closed position, the latch may move from the open position to the secondary latch position, as represented by operation 406. In operation 406, the striker 34 may contact the primary pawl 36 so the primary pawl engages the striker 34.

In operation 408, the spindle drive 18 may retract or continue retract. The spindle drive may operate at various sensor values, e.g., speed, current, voltage, wattage, force, time, or some combination thereof. These sensor values may be measured by the sensors illustrated in FIG. 9. The sensor values may be compared to a corresponding predetermined sensor value $V_i$. If one or more of the sensor values exceeds or falls below one or more of the predetermined sensor values $V_i$ (e.g., threshold), the controller 202 branches to operation 412. In operation 412, the spindle assembly 18 may stop or reverse directions of the spindle assembly 18. As one example, if an object is disposed between the closure 14 or latch 30 and the body 12 one or more of the sensor values may fall below or exceed one or more of the predetermined sensor values $V_i$.

As another example, the sensor value $V_i$ may be a latch signal triggered by the latch switch 206 that is indicative of the latch moving from open to the secondary latch position, or moving from the secondary latch position to the primary latch position, or both.

In one or more embodiments, the spindle drive 18 may apply a constant force to move the closure 14 to the closed position. Alternatively, a non-constant force may be applied, particularly if the slide mechanism 28 is configured to actuate in a non-linear manner. The actuation of the spindle drive 18 may retract for a predetermined period or fixed amount of time.

If one or more of the sensor values does not exceed or fall below one or more of the predetermined sensor values the controller 202 branches to operation 414. In operation 414, the spindle drive 18 continues retracting to actuate the slide 50, as represented by operation 416.

As one example of operations 414 and 416, the spindle moves the closure from the open to the partially closed position (e.g., secondary position). At the secondary position the latch sends a signal to the controller and the controller continues to apply power to the spindle. The power or torque applied by the spindle may be increased or decreased to overcome the force of door seal so the so the closure moves from the secondary to the final closed position (e.g., primary position). Once in the secondary position, the retracting actuates the slider causing the slider to pull on the cinching cable and pull on the latch lever. The mechanical advantage in the latch system may then pull the closure into the primary position. Power to the spindle may be interrupted upon the closure reaching the primary position.

Figure 11:
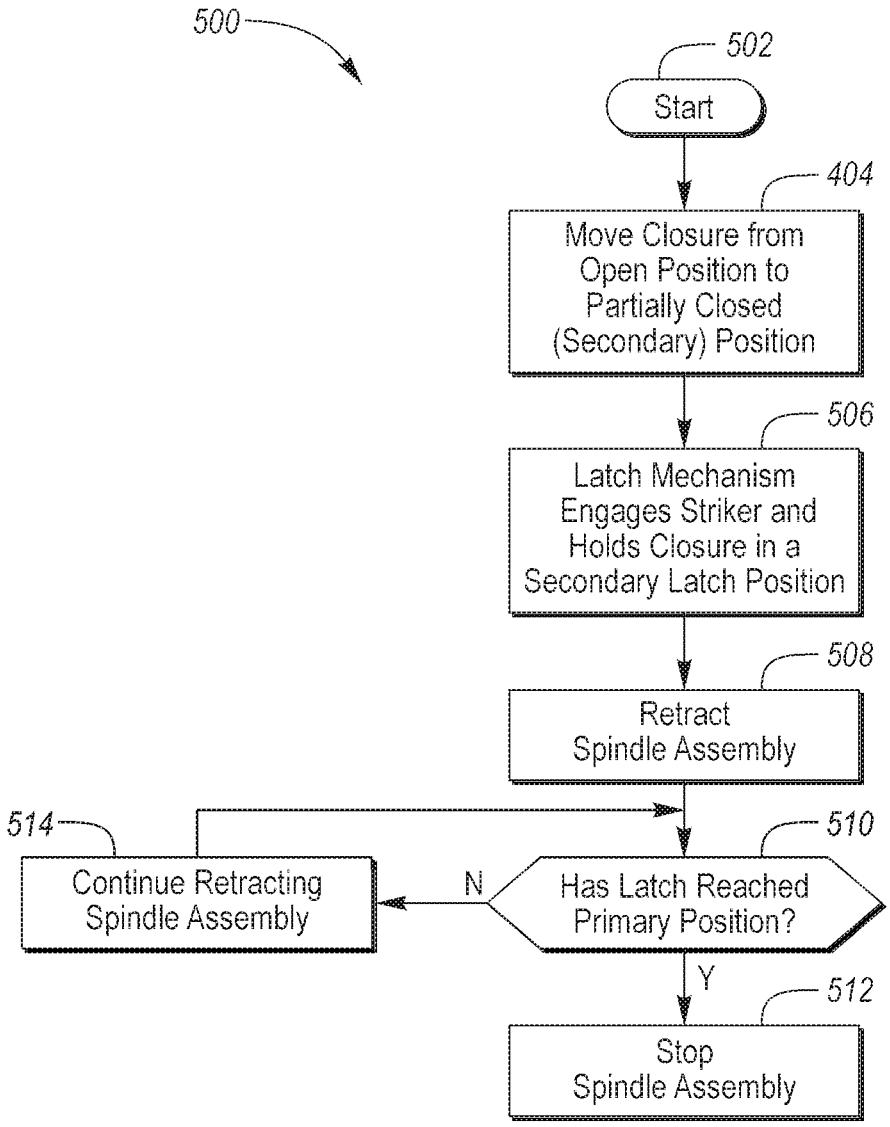
FIG. 11 is a flowchart of another exemplary method of operation of the actuation assembly.

FIG. 11 illustrates a flowchart 500 of an exemplary control strategy of the vehicle closure system. The control strategy may start by commanding the closure to close or move from an open position to a closed position, as represented by operation 502. The closure may then move from the open position to the partially closed position, as represented by operation 404 and described above. Once the closure is in the partially closed position, the latch mechanism may engage the striker so that the latch stays in the secondary latch position, as represented by operation 506. The spindle may then retract so the slide is actuated or translated, as represented by operation 508. Retracting the spindle and translating the slide may move the latch to the primary position, as represented by operation 510. Upon the latch reaching the primary position, retracting of the spindle assembly may be stopped, as represented by operation 512. If the latch has not reached the primary latch position, spindle assembly may continue to retract, as represented by operation 514.

Figure 12:
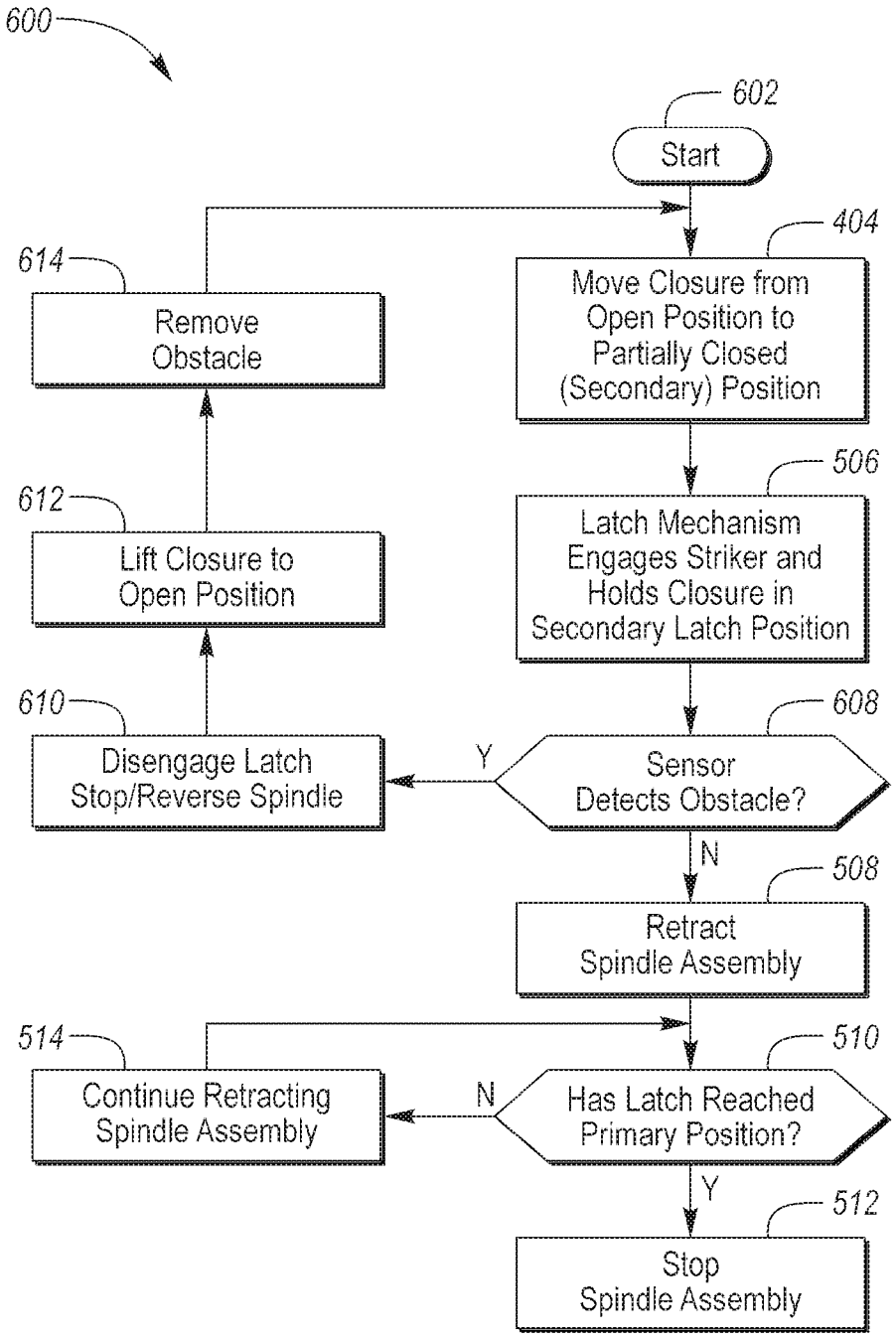
FIG. 12 is a flowchart of another exemplary method of operation of the actuation assembly.

FIG. 12 illustrates a flowchart 600 of another exemplary control strategy of the vehicle closure system. The control strategy may start by commanding the closure to close or move from an open position to a closed position, as represented by operation 602. The closure may then move from the open position to the partially closed position, as represented by operation 404 and described above. Once the closure is in the partially closed position, the latch mechanism may engage the striker so that the latch stays in the secondary latch position, as represented by operation 506. the controller may branch based on an obstacle being detected between the closure and the vehicle body, as represented by operation 608. If an obstacle is detected, the latch may disengage, and the spindle may stop or reverse directions, as represented by operation 610. If an obstacle is not detected, the spindle may retract, as represented by operation 508, until the latch reaches the primary position, as represented by operation 510.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle closure system for use with a vehicle closure, pivotally coupled to a vehicle body and movable from an open position to a closed position, the vehicle closure system comprising:

a linear drive including a first end, attachable to the vehicle body, and a second end that is configured to be coupled to the vehicle closure;

a latch, fixed to the vehicle closure, configured to engage a striker fixed to the vehicle body and move from a secondary latch position to a primary latch position;

a fixed member connected to the vehicle closure and a slide coupled to the second end of the linear drive and operatively connected to the fixed member wherein the slide is configured to move between a first deployed position and a second deployed position, when the linear drive moves the vehicle closure from the open position towards the closed position, and between the second deployed position and a retracted position, when the vehicle closure moves to the closed position; and a cable operatively connected between the slide and the latch wherein when the slide moves from the retracted position to the first deployed position, the latch moves from an open latch position to the secondary latch position, and when the slide moves from the first deployed position to the second deployed position, the latch moves from the secondary latch position to the primary latch position.

2. The vehicle closure system of claim 1, wherein the slide translates linearly with respect to the fixed member and along a first linear axis.

3. The vehicle closure system of claim 2, wherein the second end of the linear drive is configured to move along a second linear axis that is colinear with the first linear axis defined by the slide.

4. The vehicle closure system of claim 3, wherein the second end of the linear drive includes a ball and wherein the slide includes a hitch that engages an outer circumferential surface of the ball.

5. The vehicle closure system of claim 4, wherein the fixed member includes a pair of lips and wherein the slide is retained by the pair of lips.

6. The vehicle closure system of claim 5, wherein the slide defines a flange and the cable includes a wire and wherein the wire is attached to the flange.

7. The vehicle closure system of claim 6, wherein the flange is disposed on a side of the slide that extends in a direction that is transverse to the first linear axis.

8. The vehicle closure system of claim 1, further comprising a controller configured to, responsive to the vehicle closure moving to the closed position, send a signal to retract the second end of the linear drive to move the slide to the retracted position.

9. The vehicle closure system of claim 8, wherein the controller is further configured to send a signal to the linear drive so that a constant force is applied by the cable.

10. A vehicle closure system for use with a vehicle closure, pivotally coupled to a vehicle body and movable from an open position to a closed position by a spindle assembly, the vehicle closure system comprising:

a controller configured to, responsive to the vehicle closure moving to the closed position, power the spindle assembly to retract a slide between a first deployed position, a second deployed position, and a retracted position, the slide connected to a latch by a cable so that the latch moves from a secondary latch position to a primary latch position in response to the slide translating from a first deployed position and a secondary deployed position, and the latch moves from an open latch position to a secondary latch position in response to the slide translating between the first deployed position and the retracted position.

11. The vehicle closure system of claim 10, wherein the controller is further configured to power the spindle assembly so that a predetermined force is applied to the slide and the cable.

12. The vehicle closure system of claim 11, wherein the predetermined force is a constant force applied over a predetermined period.

13. The vehicle closure of claim 11, wherein the controller is further configured to stop retracting the slide responsive to a force required to move the latch from the secondary latch position to the primary latch position exceeding a threshold.

14. The vehicle closure system of claim 11, wherein the controller is further configured to power the spindle at a predetermined speed so that the time required to move the latch from the secondary latch position to the primary latch position is above a minimum threshold.

15. The vehicle closure system of claim 14, wherein the controller is further configured to, responsive to the latch moving to the primary latch position, interrupt power to the spindle assembly.

16. An actuation assembly operatively coupled to a spindle assembly, configured to close a vehicle hatch pivotally connected to a vehicle body, and a latch fixed to the vehicle hatch, the actuation assembly comprising:

a base member, attachable to the vehicle hatch, having an elongated body that defines a longitudinal axis wherein the body includes two sides that are parallel to the longitudinal axis and each of the sides include a guide; and a slide having an elongated body that is slidably coupled to the guide on each of the sides and wherein the slide is operatively coupled to the spindle assembly and the latch by a cable so that when the spindle assembly is powered to move the vehicle hatch from a partially closed position to a closed position, the slide translates from a first deployed position and a second deployed position to move the latch from a secondary latch position to the primary latch position, and when the spindle assembly is powered to move the vehicle hatch from a partially closed position to a complete open position, the slide translate from a first deployed position and a retracted position to move the latch from the secondary latch position to an open latch position.

17. The actuation assembly of claim 16, further comprising a controller, wherein the controller is configured to increase power to the spindle in response to the vehicle hatch moving to a partially closed position.

18. The actuation assembly of claim 17, wherein the latch includes a switch operatively connected to the controller and wherein the switch is actuated when the latch moves from an open position to the secondary latch position.

19. The actuation assembly of claim 18, wherein the controller is further configured to move the latch from the secondary latch position to the open position, responsive to a comparison of a sensor value to a threshold condition.

20. The actuation assembly of claim 19, wherein the sensor value is a speed of the spindle assembly, when the spindle assembly moves the vehicle hatch from the partially closed position to the closed position, and wherein the threshold condition is a predetermined speed.

* * * * *